United States Patent [19]

Maes

[11] 4,253,889

[45] Mar. 3, 1981

[54] TWO-COMPONENT EXPLOSIVE COMPOSITION

[76] Inventor: Michel E. Maes, 14508 SE. 51st St., Bellevue, Wash. 98006

[21] Appl. No.: 964,488

[22] Filed: Nov. 29, 1978

[51] Int. Cl.[3] ..... C06B 31/32

[52] U.S. Cl. ..... 149/47; 86/20 R; 86/20 C; 102/23; 149/62; 149/76; 149/78

[58] Field of Search ..... 86/20 R, 20 C; 149/45, 149/47, 87, 89; 102/23; 146/62, 76, 78

[56] References Cited

U.S. PATENT DOCUMENTS

| | | | |
|---|---|---|---|
| 3,133,844 | 5/1964 | Royer et al. | 149/89 X |
| 3,380,333 | 4/1968 | Clay et al. | 86/20 C |
| 3,810,425 | 5/1974 | Post | 149/89 X |
| 4,093,478 | 7/1978 | Hurst | 149/89 X |

FOREIGN PATENT DOCUMENTS

| | | | |
|---|---|---|---|
| 695713 | 10/1964 | Canada | 149/47 |

OTHER PUBLICATIONS

The Condensed Chemical Dictionary, Van Nostrand Reinhold Co., New York, 1977, p. 449.

*Primary Examiner*—Leland A. Sebastian
*Attorney, Agent, or Firm*—Seed, Berry, Vernon & Baynham

[57] ABSTRACT

A two-component explosive composition is disclosed in which each of the components, in and of themselves, is non-detonable. At the use site, the components are readily mixed to form a No. 6 cap-sensitive explosive composition. The composition includes (1) a solid dry component, preferably granular ammonium nitrate or like solid oxidizer and (2) a liquid component for admixture with the dry component consisting essentially of a non-self reacting compound with a fuel value of less than 5 kcal./gm. in which is dispersed 2% to 40% by weight based on the weight of the dry composition of a lower nitro-aliphatic fuel.

12 Claims, No Drawings

TWO-COMPONENT EXPLOSIVE COMPOSITION

BACKGROUND OF THE INVENTION

1. Field of the Invention

This invention relates to a two-component explosive composition, to a method of making such and to a packaging system for such explosive composition.

2. Prior Art Relating to the Disclosure

Two-component explosive compositions have primary application for remote uses where transportation of the explosive composition is necessary. Explosive compositions which are cap-sensitive, for example, to a No. 6 explosive cap, must be shipped in interstate commerce under the explosive regulations which increases the cost of such compositions markedly.

U.S. Pat. No. 3,718,512 discloses a two-component explosive composition comprising a liquid component and a dry component. Specifically, the patent discloses ammonium nitrate comminuted to a particle size of less than 1,000 microns and preferably 5–250 microns as the dry component admixed with nitromethane to which a liquid hydrocarbon fuel may be added. The nitromethane constitutes, preferably, from 12–35% by weight of the total composition. The mixing time of the explosive composition taught by the above patent is excessive.

U.S. Pat. No. 4,076,562 discloses a method of rendering combustible liquids explosive and sensitive to a No. 6 blasting cap, primarily nitroalkane materials, by combining the combustible liquid with air entrapment materials, such as small, hollow glass microspheres, to which finely divided oxidizing salts, such as ammonium nitrate, are adhesively adhered. The patent mentions that the combustible liquid should contain at least 80% nitromethane mixed with other combustible liquids. The disclose of the patent makes no distinction between the fuels mentioned. Further, the composition requires that the air entrapment particles make up, preferably 3% to It is also an object of the present invention to provide a two-component explosive composition wherein the detonation velocity of the explosive composition can be varied.

It is a further object of the invention to provide a two-component explosive composition in which the explosive composition can be totally desensitized during transportation.

The two-component composition is one in which each component of the two-component mixture is non-detonable in and of itself but, when combined, is sensitive to a No. 6 blasting cap. The composition includes a dry component consisting of a granular solid oxidizer such as ammonium nitrate and a liquid component for admixture with the dry component at the use site consisting essentially of a non-self reacting compound with a fuel value of less than 5 kcal./gm. in which is dispersed a non-cap sensitive liquid nitroaliphatic hydrocarbon, the amount of liquid component added to the dry component being sufficient to result in from 2–40% by weight of the liquid nitro-aliphatic hydrocarbon based on the weight of the dry component.

Mixing of the dry and liquid components can be accomplished without mechanical agitation by capillary action of the liquid component in the solid component. The mixture does not separate or stratify and gelling agents are not required to remain homogeneity.

DESCRIPTION OF THE PREFERRED EMBODIMENTS

The liquid component of the explosive composition can be stored and transferred in interstate commerce without having to meet explosive regulations as it is totally desensitized and non-detonable. The liquid component includes a non-self reacting hydrocarbon that is liquid at atmospheric pressure with a fuel value of less than about 5 kcal./gm., preferably less than 4 kcal./gm. such as a low molecular weight halogenated hydrocarbon or amide, and a non-cap-sensitive nitro-aliphatic hydrocarbon having from one to three carbon atoms, preferably nitromethane. In the explosive composition the nitro-aliphatic hydrocarbon should be present in an amount ranging from 2–40% by weight based on the weight of the dry component. The non-self reacting hydrocarbon in which the nitro-aliphatic hydrocarbon is soluble functions as an extender to spread the nitro-aliphatic hydrocarbon uniformly, by capillary action, through the dry component when the two components are mixed together. A sufficient amount of non-self reacting hydrocarbon in admixture with the nitro-aliphatic hydrocarbon should be used to enable uniform mixing of the nitro-aliphatic compound hydrocarbon with the solid component. The weight ratio of nitro-aliphatic compound to non-self reacting hydrocarbon may range from 25:75 to 90:10, preferably about 50:50. It is important that a non-self reacting hydrocarbon be used rather than a high-fuel value hydrocarbon, such as an aromatic or aliphatic hydrocarbon, lower aliphatic alcohol, ether, aldehyde, organic acid, or ester. Such high-fuel value hydrocarbons have been found to desensitize the explosive composition rather than enhance it. The preferred non-self reacting hydrocarbons include low molecular weight halogenated hydrocarbons, such as trichloroethane, trichloroethylene, perchloroethylene and perchloroethane. Other hydrocarbons which may be used include formamide.

The combination of a low molecular weight halogenated hydrocarbon and nitro-aliphatic hydrocarbon as the liquid component markedly improves the mixing time of the two-component explosive composition when the liquid and dry components are mixed together, apparently because the liquid component tends to better penetrate the solid component which is generally a granular ammonium nitrate.

The solid or dry component of the explosive composition is a non-cap-sensitive, granular, solid oxidizer which can be shipped in interstate commerce without having to meet the explosive regulations. The solid component may be stored and transported in any suitable bulk container. Preferably the solid component is packaged in bulk in plastic-lined paper bags. The function of the solid component is (1) to provide additional energy through reaction of oxidizer groups with the nitro-aliphatic fuel and (2) to uniformly disperse the liquid component. Solid or dry components which may be used include granular ammonium nitrate or other granular solid oxidizers such as the alkali or alkaline or metal nitrates or perchlorates, and ammonium perchlorate.

At the use site a measured amount of the dry component is mixed with a corresponding measured amount of the liquid component and the two shaken together by hand. The resulting mixture has a consistency of damp sand and is easily transferable to other convenient containers or directly pourable into drill holes.

The two-component explosive composition remains cap sensitive to a No. 6 cap (one-inch diameter drill hole) over a range of 2–30% by weight nitro-aliphatic hydrocarbon relative to the weight of the dry component at a 50:50 volume ratio of the nitro-aliphatic hydrocarbon to the non-self reacting hydrocarbon. At the lower level of 2% by weight nitro-aliphatic hydrocarbon, a lower detonation velocity explosive is obtained, whereas at 30% by weight nitro-aliphatic hydrocarbon, a high detonation velocity explosive is obtained suitable for blasting rocks. The ability to tailor the detonation velocity of the explosive composition as desired is a definite advantage.

In general, in the explosive art, it has been thought that when a non-detonable diluent of low fuel value is added to an explosive composition it reduces the sensitivity of the composition; therefore, low fuel value components are generally not used. Contrary to this belief, however, the explosive composition described makes use of a large quantity of a non-self reacting, low fuel value diluent in admixture with a nitro-aliphatic hydrocarbon considerably below the stoichiometric amount generally considered necessary, relative to the solid component. Yet with such compositions good sensitivity is obtained.

The two-component compositions are packaged in separate containers. Preferably, the liquid component is packaged in a metal can or glass container and the solid component is packaged in plastic-lined paper bags or plastic bags. A mixing container is preferably provided with sufficient volume such that when the two components are mixed together in the proper ratio, from 10% -30% free volume remains in the container. Therefore, when the two components are mixed together there is sufficient free volume in the container for shaking the two components together to assist in uniform mixing. The resulting explosive composition is free flowing.

The following examples are not intended to be limiting of the invention in any manner.

In the following series of tests, various explosive compositions of the prior art and explosive compositions of this invention were tested for sensitivity to detonation. In each case the liquid and dry components of the explosive composition containing the amounts (in grams) listed in Table I were shaken together by hand and loaded into one-inch diameter paper tubes. Detonation was initiated in each case by a commercial electric No. 6 blasting cap inserted in one end of the paper tube into the explosive composition. The results are given in Table I:

TABLE I

| Test | 1A | 1B | 1C | 1D | 1E | 1F | 1G | 1H | 1I |
|---|---|---|---|---|---|---|---|---|---|
| Crushed ammonium nitrate | 50 | 50 | 50 | 50 | 50 | 50 | 50 | 50 | 50 |
| Nitromethane | 1.75 | 3.5 | 7 | 7 | 3.5 | 3.5 | 7 | 7 | 3 |
| Trichloroethane | 1.75 | 3.5 | 7 | | | | | | |
| Xylene | | | | 7 | 3.5 | | | | 1 |
| Methyl Alcohol | | | | | | 3.5 | 7 | | |
| Perchlorethylene | | | | | | | | 7 | 3 |
| Detonation (P-positive) (N-negative) | P | P | P | N | N | P | N | P | P |

In tests 1A, 1B and 1C, equal amounts of trichloroethane and nitromethane were used in varying amounts relative to the amount of ammonium nitrate. Detonation in each instance was positive. In tests 1D and 1E, employing equal amounts of xylene (a high value fuel) and nitromethane in varying amounts relative to the amount of ammonium nitrate, detonation was not achieved. In tests 1F and 1G employing equal amounts of methyl alcohol and nitromethane, detonation was not obtained except with a relatively low amount of nitromethane relative to the ammonium nitrate. In tests 1H and 1I, detonation was positive. The tests illustrate that, contrary to general belief, the use of a relatively large quantity of non-self reacting low fuel value diluent in the explosive compositions did not reduce the sensitivity of the composition, while fuel rich explosive compositions illustrated by tests 1D, 1E, 1F and 1G did not have the same relative sensitivity and reliability.

In the following series of tests, various explosive compositions of the prior art and those of this invention were tested for brisance. The brisance tests were all carried out by placing substantially identical amounts of the explosive compositions given in Table II in $1\frac{1}{8}''$ diameter plastic vials with recessed bottoms, mounted on $\frac{1}{4}''$ thick, 4" diameter steel plates. Detonation was initiated in each instance by a No. 6 electric blasting cap inserted into the top of the vial. The results were as follows:

TABLE II

| Test | 2A | 2B | 2C | 2D | 2E | 2F | 2G | 2H | 2I | 2J |
|---|---|---|---|---|---|---|---|---|---|---|
| Granular ammonium nitrate | 40 | 40 | 40 | 40 | | 40 | 40 | 40 | 40 | |
| Nitromethane | 4 | 6 | 7 | 9 | | 2.8 | 4 | 5 | 5.5 | |
| Trichloroethane | 3 | 3 | 3 | 3 | | 2.8 | 4 | 5 | 5.5 | |
| Kinestik***solid* | | | | | 40 | | | | | |
| Kinestik***liquid** | | | | | 12 | | | | | |
| 70% dynamite | | | | | | | | | | 50 |
| Depth of dent in steel plate (in .001 inches) | 50 | 73 | 93 | 103 | 103 | 44 | 64 | 68 | 70 | 52 |

*finely crushed ammonium nitrate
**believed to be 95% nitromethane and 5% nitropropane
***Kinestik is a tradename of Atlas Powder Company Tests 2A, 2B, 2C and 2D illustrate the manner in which the detonation velocity of the explosive composition can be varied by increasing the nitromethane content of the explosives composition. Test 2E utilized a commercially available two-component explosive composition sold under the tradename Kinestik. The solid component of the Kinestik composition is finely crushed ammonium nitrate and the liquid component is believed to be a mixture of 95% by wt. nitromethane and 5% by wt. nitropropane. As illustrated, the brisance of test 2D employing considerably less nitromethane than test 2E was comparable. Tests 2F, 2G, 2H and 2I illustrate that the detonation velocity of the explosive composition of this invention can also be varied by increasing the amount of the liquid component relative to the amount of the dry component. Test 2J was one conducted with 70% dynamite.

I claim:

1. A two-component explosive composition sensitive to a No. 6 blasting cap, each component of the two-component mixture being non-detonable in an of itself, comprising:

a dry component comprising a granular solid oxidizer selected from the group consisting of alkali and alkaline earth metal nitrates, alkali and alkaline earth metal perchlorates, ammonium nitrate and ammonium perchlorate; and a liquid component in admixture with the dry component comprising a non-self reacting liquid compound selected from the group consisting of halogenated hydrocarbons and formamide with a fuel value of less than 5 kcal./gm. and a non-cap-sensitive liquid nitro-aliphatic hydrocarbon, the amount of liquid component relative to the dry component being sufficient to result in at least 2% by weight and not more than 40% by weight of the liquid nitro-aliphatic hydrocarbon based on the weight of the dry component.

2. The composition of claim 1 wherein the liquid nitro-aliphatic hydrocarbon is nitromethane and the non-self-reacting liquid compound is a halogenated hydrocarbon selected from the group consisting of trichloroethane, trichloroethylene and perchloroethylene.

3. The composition of claim 1 wherein the weight ratio of nitro-aliphatic hydrocarbon to non-self-reacting liquid compound ranges from 25:75 to 90:10.

4. The composition of claim 1 wherein the liquid nitro-aliphatic hydrocarbon is nitromethane and the non-self-reacting liquid compound is trichloroethane present in the liquid component in an equal amount by weight with the nitromethane.

5. The composition of claim 1 wherein the liquid nitro-aliphatic hydrocarbon is nitromethane and the non-self-reacting liquid compound is formamide.

6. A method of forming an explosive using a two-component explosive composition sensitive to a No. 6 blasting cap where each component of the two-component mixture is non-detonable in and of itself, comprising:

pouring a measured amount of solid, granular oxidizer selected from the group consisting of alkali and alkaline earth metal nitrates, alkali and alkaline earth metal perchlorate, ammonium nitrate and ammonium perchlorate into a container having 10%–30% free volume after filling with the oxidizer;

pouring a measured amount of a liquid component consisting essentially of a non-self-reacting liquid compound selected from the group consisting of halogenated hydrocarbons and formamide with a fuel value of less than 5 kcal./gm. and a non-cap-sensitive liquid nitro-aliphatic hydrocarbon into the measured amount of a dry granular solid oxidizer, the amount of liquid component added to the dry component being sufficient to result in at least 2% by weight of liquid nitro-aliphatic hydrocarbon relative to the dry component, and shaking the two components together in a container to uniformly mix the liquid component with the dry component.

7. A method of forming an explosive using a two-component explosive composition where each component of the two-component mixture is non-detonable in and of itself, comprising:

pouring a measured amount of solid, granular oxidizer into a container having 10% to 30% free volume after filling with the oxidizer, pouring a measured amount of a liquid component consisting essentially of a non-self-reacting liquid hydrocarbon selected from the group consisting of halogenated hydrocarbons and formamide with a fuel value of less than 5 kcal./gm. and a non-cap-sensitive liquid nitro-aliphatic hydrocarbon into the measured amount of solid oxidizer, the amount of liquid component added to the dry component being sufficient to result in at least 2% by weight and not more than 40% by weight of liquid nitroaliphatic hydrocarbon relative to the dry component, and shaking the two components together in the container to uniformly mix the liquid component with the dry component.

8. The method of claim 7 wherein the solid oxidizer is one selected from the group consisting of alkali and alkaline earth metal nitrates, alkali and alkaline earth metal perchlorates, ammonium nitrate and ammonium perchlorate and wherein the liquid component includes a lower molecular weight liquid nitro-aliphatic hydrocarbon having from 1 to 3 carbon atoms.

9. The method of claim 6, wherein the liquid nitro-aliphatic hydrocarbon is nitromethane and wherein the non-self-reacting liquid compound is a halogenated hydrocarbon selected from the group consisting of trichloroethylene, trichloroethane and perchloroethylene.

10. The method of claim 6, wherein the weight ratio of nitro-aliphatic hydrocarbons to non-self-reacting liquid compound ranges from 25:75 to 90:10.

11. The method of claim 6, wherein the liquid nitro-aliphatic hydrocarbon is nitromethane and the non-self-reacting liquid compound is trichloroethane present in the liquid component in an equal amount by weight with the nitromethane.

12. The method of claim 6, wherein the liquid nitro-aliphatic hydrocarbon is nitromethane and the non-self-reacting liquid compound is formamide.

* * * * *